US005951052A

United States Patent [19]

Hansen et al.

[11] Patent Number: 5,951,052

[45] **Date of Patent: *Sep. 14, 1999**

[54] BILL HAVING ONE OR MORE INFORMATION PANELS AND A PERPENDICULARLY ORIENTED REMITTANCE PANEL

[75] Inventors: Pamela M. Hansen, Aurora; Larry N. Rebenack, Boulder, both of Colo.; Phyllis J. Buckman, Paradise Valley; Carol L. Rohrkemper, Glendale, both of Ariz.

[73] Assignee: US West, Inc., Denver, Colo.

[ * ] Notice: This patent is subject to a terminal disclaimer.

[21] Appl. No.: 09/121,560

[22] Filed: Jul. 23, 1998

Related U.S. Application Data

[63] Continuation of application No. 08/689,402, Aug. 8, 1996, Pat. No. 5,845,942, which is a continuation-in-part of application No. 29/048,114, Dec. 22, 1995, Pat. No. Des. 385, 298.

[51] Int. Cl.[6] ..... B42D 15/00

[52] U.S. Cl. ..... 283/67; 283/60.1; 283/66.2; 283/66.1

[58] Field of Search ..... 283/61, 62, 67, 283/60.1, 66.1; 281/2, 5, 46; 229/301–305

[56] References Cited

U.S. PATENT DOCUMENTS

| | | | |
|---|---|---|---|
| D. 39,492 | 9/1908 | Guy . | |
| D. 269,282 | 6/1983 | Svegin . | |
| D. 322,807 | 12/1991 | Sisilli . | |
| 934,073 | 9/1909 | Hutchinson . | |
| 2,016,063 | 10/1935 | White . | |
| 2,394,247 | 2/1946 | Lorber . | |
| 4,441,739 | 4/1984 | Cluff et al. | 281/16 |
| 4,524,993 | 6/1985 | Walker-Taylor | 281/46 |
| 4,614,364 | 9/1986 | Bortner | 283/45 |
| 4,685,699 | 8/1987 | Hirasawa | 283/56 |
| 4,781,322 | 11/1988 | Humm | 229/73 |
| 5,169,060 | 12/1992 | Tighe et al. | 229/301 |
| 5,219,184 | 6/1993 | Wolf | 283/56 |
| 5,271,641 | 12/1993 | Whited | 283/80 |
| 5,299,835 | 4/1994 | Sonnenberg | 283/56 |
| 5,308,118 | 5/1994 | Ovadia | 283/56 |
| 5,372,302 | 12/1994 | Loch et al. | 229/305 |
| 5,402,934 | 4/1995 | Sanerwine | 229/303 |
| 5,419,590 | 5/1995 | Rothschild | 283/79 |
| 5,467,917 | 11/1995 | Potter | 229/301 |
| 5,603,529 | 2/1997 | Breindel . | |
| 5,845,942 | 12/1998 | Hansen et al. | 283/67 |

FOREIGN PATENT DOCUMENTS 2 199 788 7/1988 United Kingdom .

*Primary Examiner*—Willmon Fridie, Jr.
*Attorney, Agent, or Firm*—Brooks & Kushman

[57] ABSTRACT

A bill comprises a first sheet of paper having two or more information panels and a remittance panel defined therein. Information (e.g., text) in the information panels is oriented in a first direction, and information in the remittance panel (e.g., text) is oriented in a second direction, perpendicular to the first direction. In one embodiment, first sheet comprises two information panels on a first side, and two information panels on a second side. A first information panel comprises summary information; second and third information panel comprises billing information, and a fourth information panel comprises advertising information. The bill is folded such that information in the information panels reads like a book (excepting the remittance panel which is generally tom off). In another embodiment, information in side-by-side panels comprise information in two languages, for example English and Spanish. In a preferred method for printing, the bill is printed using a continuous roll of paper and is printed "two-up" (two bills are generated at a time, side-by-side).

21 Claims, 4 Drawing Sheets

BILL HAVING ONE OR MORE INFORMATION PANELS AND A PERPENDICULARLY ORIENTED REMITTANCE PANEL

This application is a continuation of Ser. No. 08/689,402 filed Aug. 8, 1996, now U.S. Pat. No. 5,845,942 is a continuation in part of a U.S. design patent application Ser. No. 29/048,114 titled "Bill or Invoice or the Like," filed on Dec. 22, 1995, now U.S. Pat. No. 2,385,298 by Pamela M. Hansen and assigned to U S WEST, Inc., the contents of which are incorporated herein by reference.

BACKGROUND OF THE INVENTION

1. Field of the Invention

This invention relates generally to bills or invoices, and in particular to a bill with one or more portrait oriented panels and a landscape oriented remittance panel.

2. Description of the Related Art

Bills or invoices are widely used in many areas of commerce. For creditors mailing such bills, it is desirable to minimize the number of sheets of paper in the bill in order to reduce postage and production costs. If a bill is over approximately 4 standard 8 ½"×11" sheets, postage costs increase significantly. In production, a one-sheet bill is easier to create, collate, stuff, store, and handle, than multi-sheet bills. The benefits of one-sheet bills are especially realized in large-volume billing environments such as the telecommunications, cable, public service (electric/gas service), or water and sewer industries.

It is also desirable to convey relevant information to the bill recipient. In some markets, for example the telecommunications, cable, and public service markets, large amounts of diverse information is either required by regulation, or should be provided to the recipient for convenience and understanding. For example, in the telecommunications market, local charges, long distance charges, regulated charges, unregulated charges, and taxes, are either required, or should be included, in the bill. Often this information comprises billing information from a plurality of creditors or sources. In some cases, billing information from each creditor or source is required to be, or should be, displayed separately. For example, in the telecommunications market, itemization of local charges and each long distance carrier (e.g., AT&T, Sprint, MCI) are displayed on separate pages of the bill. As local telecommunications companies, long-distance telecommunications therefor companies, cable companies, and internet provider companies combine various services, additional sources of information are created (e.g., basic cable rates, added cable options, one-time pay-per-view events, internet services charges, specific on-line vendor charges (e.g., Dow Jones Retrieval, America On-Line, etc.)). These additional sources of billing information further complicate the bill presentation and generally confuses the consumer. Similarly, gas, and electric charges for a public service bill are generally separated. Conventional bills either display such information from each creditor all on one page or area on the bill, or on separate sheets of paper or separate sides of a sheet.

It is also desirable to make a bill easy to follow and understand. Such a bill decreases the likelihood of customer inquiries about the information in the bill, thus help desk personnel requirements to handle such inquiries are reduced. It is also desirable to make bill payment simple to encourage prompt payment. Conventional bills include a perforated remittance portion attached to the bottom of a bill itemization section. Largely due to printing limitations, the bill itemization and remittance information (e.g., the text) are oriented the same direction.

SUMMARY OF THE INVENTION

A bill comprises a first sheet of paper having two or more information panels and a remittance panel defined therein. Information (e.g., text) in the information panels is oriented in a first direction, and information in the remittance panel (e.g., text) is oriented in a second direction, perpendicular to the first direction. In one embodiment, first sheet comprises two information panels on a first side, and two information panels on a second side. A first information panel comprises summary information; second and third information panel comprises billing information, and a fourth information panel comprises advertising information. The bill is folded such that information in the information panels reads like a book (excepting the remittance panel which is generally torn off). In another embodiment, information in side-by-side panels comprise information in two languages, for example English and Spanish. In a preferred method for printing, the bill is printed using a continuous roll of paper and is printed "two-up" (two bills are generated at a time, side-by-side).

DESCRIPTION OF THE PREFERRED EMBODIMENTS

Figure 1:
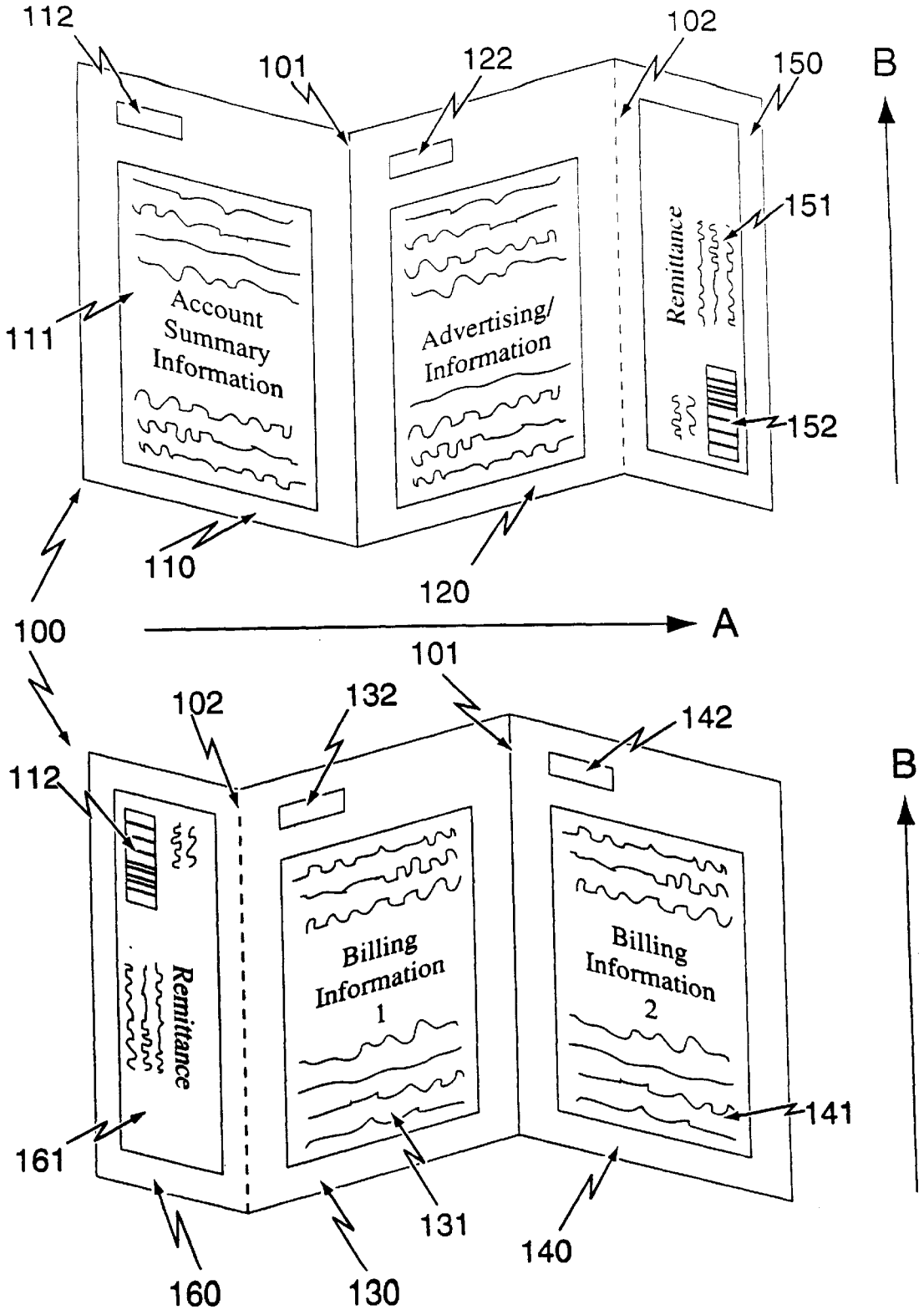
FIG. 1 is the front and back view of a first sheet of a bill according to the present invention having two information panels on a side and a remittance panel.

FIG. 1 is a front and back view of the first sheet of a bill or invoice according to the present invention. In one embodiment, the first sheet of bill 100 is a standard 8 ½" height by 14" length sheet and is made from standard paper stock (e.g., 20 lb. weight). Alternatively other standard paper sizes, such as A4 width with an extension in length, or non-standard sizes can be used.

Fold lines 101 and 102 define panels 110, 120, and 150 on a first side of bill 100, and also define panels 130, 140 and 160 on a second side of bill 100. In one embodiment, panels 110, 120 (and 130, 140) are approximately equal in size and are approximately 8 ½" in height and 5 ½" in width. Thus, the area of panels 110, 120 (or 130, 140) together measure to a standard 8 ½" by 1141 sheet of paper. Alternatively, other standard paper size dimensions, such as A4, or non-standard sizes can be used, or, the panels can be different in size. Remittance panel 150 (160) is located at either end of the sheet of paper. In one embodiment, panel 150 (160) is 3" by 8 ½". Thus, together, the area of panels 110, 120, and 150 (or on the opposite side 130, 140 and 160) measure to a standard 8 ½" by 14" sheet of paper.

In one embodiment, bill 100 is folded along fold line 101 such that panels 110 and 120 face out and panels 130 and 140 face each other. Panel 150/160 is folded along fold line 102 in either direction. Alternatively, bill 100 is folded such that panel 110 and 120 face each other, panels 130 and 140 face out, and panel 150/160 is folded in either direction. In one embodiment fold line 102 is perforated for easy detachment.

Panels 110, 120, 130 and 140 comprise information 111, 121, 131 and 141 (e.g., summary information, advertising information, and/or billing information, etc.). In one embodiment, one or more panels 110, 120, 130 and 140 comprise summary information, for example, total amount due, due date, balance forward, and new charges. In a preferred embodiment a first panel (panel 110 as shown in FIG. 1) comprises summary information 111. Thus, the recipient is provided summary information on the first panel or page of the bill.

In one embodiment, one or more panels 110, 120, 130 and 140 comprise information in two or more languages. For example, panel 110 comprises billing information in a first language (e.g., English), and panel 120 comprises the same billing information, but in a second language (e.g., Spanish). Similarly, panel 130 comprises billing information in the first language (e.g., English), and panel 140 comprises the same billing information in the second language (e.g., Spanish). In a preferred embodiment, text from the two languages appear in side-by-side panels. Thus, a bilingual bill is clearly and efficiently presented to the customer/debtor.

In one embodiment, one or more panels 110, 120, 130 and 140 comprise advertising or other promotional information (e.g., advertising of the creditor or another party). In one embodiment, a second panel (panel 120 as shown in FIG. 1) comprises advertising information 121. Thus, the recipient readily sees such advertising.

In one embodiment, one or more panels 110, 120, 130 and 140 comprise billing information from two or more different creditors. In a preferred embodiment, panels 130 and 140 comprise billing information 131 and 141, respectively, each from a different creditor. By dividing a physical page of bill 100 into smaller panels 110, 120, 130 and 140, small amounts of information from various sources (e.g., multiple creditors or sources, summary information, or advertising) can be segregated and each occupy a separate panel. Thus, a small amount of information need not occupy an entire page with large amounts of unused space (referred to as "white space"). According to the present invention, bills can be printed on fewer sheets of paper, thereby reducing mailing and production costs. In addition, the bill is easily comprehended by the debtor because the information is segregated by creditor in each panel.

In one embodiment, bill 100 is presented in a book-like format. Page 1 of the book 1 is panel 110, preferably comprising summary information 111. Turning the book over, page 2 is panel 120 preferably comprising advertising information 121, or alternatively billing information. Opening the book, page 3 is panel 130, and page 4 is panel 140 with pages 3 and 4 comprising billing information (131 and 141). Remittance panel 150/160 is not included in the "book" as it is generally tom off. Information 111, 121, 131, and 141 is oriented in a first direction, A, as shown in FIG. 1. As shown in FIG. 1, information 111, 121, 131, and 141 (e.g., text) run horizontally left to right and is oriented in a portrait format within the panels 110, 120, 130 and 140, respectively. As bill 100 is opened and turned over information 111 and 121 and information 131 and 141 are oriented in the same direction, A (like a book). The book-like presentation format of the present invention is familiar to the debtor and more readily comprehended. Thus, fewer customer inquiries are made regarding the bill or the information therein.

Optionally, one or more panels 110, 120, 130, 140 comprise creditor or source identification 112, 122, 132, 142, for example, company logos.

Panel 150 (and 160 on the opposite side) is a remittance panel and comprises remittance information 151. Preferably remittance information 151 comprises creditor information (e.g., creditor name and address, account number, amount due, due date). Optionally, selected portions of creditor information 151 can be encoded in a bar code 152 to expedite the automated mailing process. Preferably remittance information 161 comprises debtor information (e.g., debtor name and address). Optionally, selected portions of debtor information 161 can be encoded in a bar code 162. Creditor information 151 and debtor information 161 are typically positioned within remittance panel such that proper address information is visible through a window in an envelope for mailing purposes.

Remittance information 151/161 is oriented in a second direction, B, perpendicular to the first direction, A, of information 111, 121, 131, and 141. As shown in FIG. 1, remittance information 151/161 (e.g., text) runs vertically up, and is oriented landscape within panel 150/160. Most conventional high-volume printing processes are unable to print text on one physical sheet of paper in multiple orientations (e.g., horizontal and vertical text) for a plurality of logical panels defined within the physical sheet of paper. Thus, prior art bills generally have text oriented in one direction only. In a preferred implementation, bill 100 is printed using an IBM 3900 printer (XEROX or other comparable printers can also be used) continuous sheet/roll printer (as opposed to a cut sheet paper printer--the continuous printer is generally faster). Also in a preferred embodiment, bills are generated by printing "two-up" - - - that is two bills are printed at a time side-by-side (which also decreases the print process time). The process of the present invention is facilitated with software control provided by FIR (Flexible Invoice Repository), available from Pacific Bell and Arthur Anderson Consulting. FIR is able to define a plurality of logical panels within a physical sheet of paper, each panel having an associated orientation of text.

Figure 2:
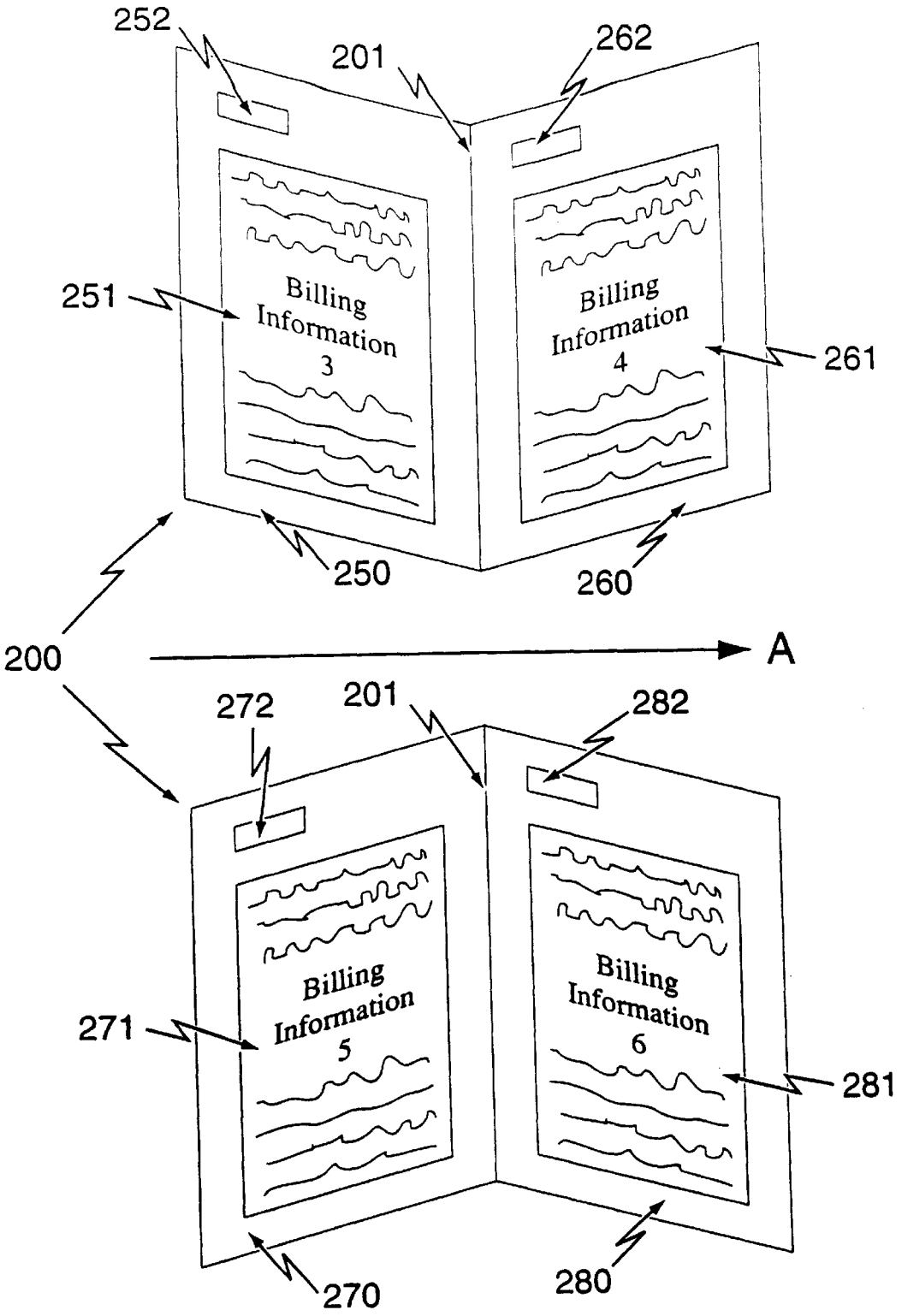
FIG. 2 is the front and back view of additional sheets of the bill in FIG. 1.

FIG. 2 is a front and back view of an optional additional sheet of bill 100. One or more additional sheets 200 are used when information content (e.g., billing information, number of creditors, advertising, summary information) of the bill requires additional sheets. In one embodiment, additional sheet 200 is a standard 8 ½" height by 11" length sheet made from standard paper stock (e.g., 20 lb. weight). Alternatively, other standard paper sizes, such as A4, or non-standard sizes can be used.

Fold line 201 defines panels 250, 260, 270, and 280. In one embodiment, panels 250 and 260 (and panels 270 and 280 on the opposite side) are approximately equal in size and are approximately 8 ½" in height and 5 ½" in width. Thus, the area of panels 250 and 260 (or panels 270 and 280) together measure to a standard 8 ½" by 11" sheet of paper. Alternatively, other standard sizes such as A4, or non-standard sizes, can be used. Fold line 201 follows along substantially the same line as fold line 101 in FIG. 1. In one embodiment, additional sheet 200 is folded such that panels 250 and 260 face out and panels 270 and 280 face each other. Alternatively, additional sheet 200 is folded such that panels 250 and 260 face each other and panels 270 and 280 face out.

Panels 250, 260, 270, and 280 comprise information 251, 261, 271, and 281, respectively. Information 251, 261, 271, and 281 is oriented in the same first direction, A, as information 111, 121, 131, and 141 (FIG. 1). As shown in FIG. 2, information 251, 261, 271, and 281 (e.g., text) runs horizontally and is oriented portrait within the panels. Optionally, one or more panels comprise one or more creditor or source identifications 252, 262, 272, and 282 (e.g., one or more company logos in each location).

Bill 100 and additional sheets 200 are collated together in a book-like fashion with fold lines 101 and 201 forming the "spine" of the book. Fold line 201 of sheet 200 is aligned along a common fold line with fold line 101 of sheet 100. In one embodiment of a two-sheet bill, panel 110 is the first outside facing page; turning the book over, panel 120 is the second outside facing page; opening the book, panel 130 is the third page; panel 260 is the fourth page; turning the page, panel 270 is the fifth page; panel 280 is the sixth page; turning the page, panel 250 is the seventh page; and panel 140 is the eighth page. Preferably outside facing panel 110 comprises account summary information, outside facing panel 120 comprises advertising information, and the remaining panels comprise billing information from one or more creditor.

Figure 3:
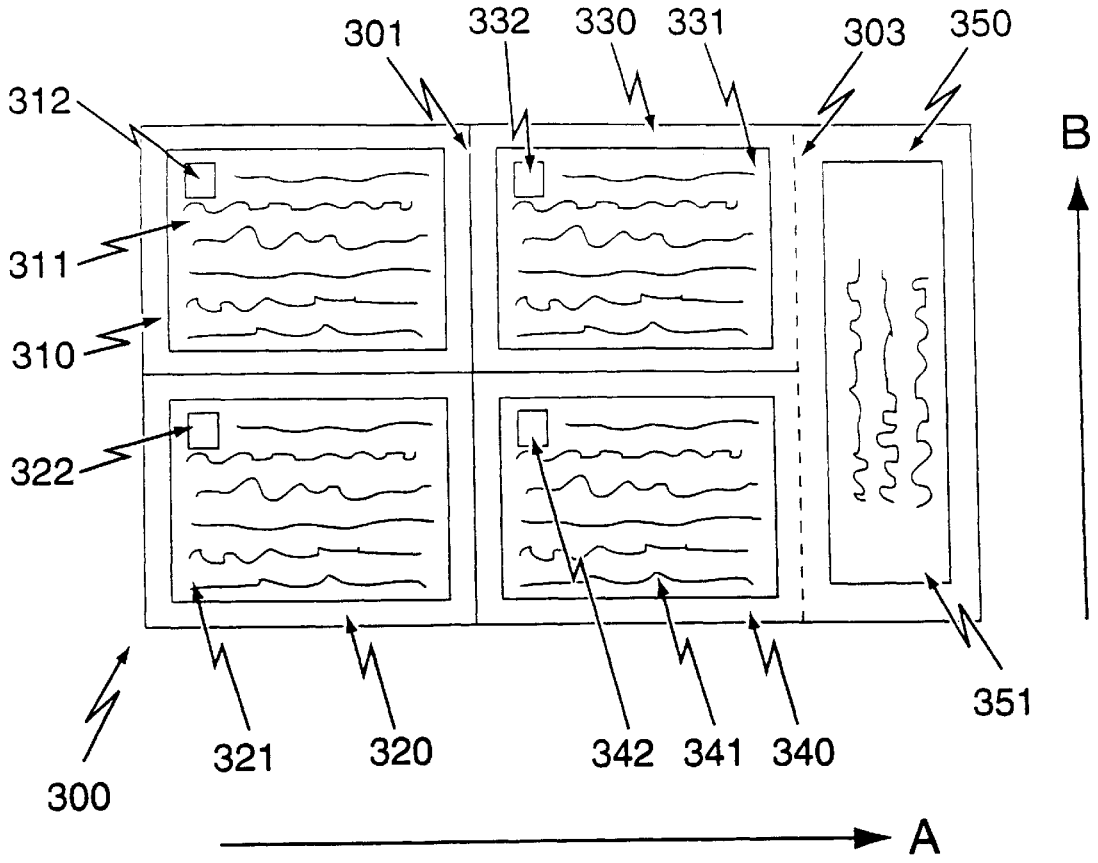
FIG. 3 is the front view of an alternative embodiment of the bill in FIG. 1 having four information panels on a side.

FIG. 3 shows an alternative embodiment of the present invention comprising four information panels. Panels 310, 320, 330, 340, 350 are defined by fold lines 301 and 303, and line 302. Panels 310, 320, 330, 340 comprise information 311, 321, 331, and 341 (e.g., account summary, billing information, advertising, or other information). Information 311, 321, 331, and 341 is oriented in a first direction, A. Optionally, each panel may comprise a creditor or source identifier 312, 322, 332, 342 (e.g., company logo). Panel 350 comprises remittance information 351. Remittance information 351 is oriented in a second direction, B, perpendicular to the first direction, A. The reverse side of bill 300 comprises a similar four information panel and one remittance panel format (not shown). Alternatively, bill 300 comprises a first side with a two-information panel format, as shown in the top of FIG. 1, and a second side with a four information panel format as shown in FIG. 3.

Figure 4:
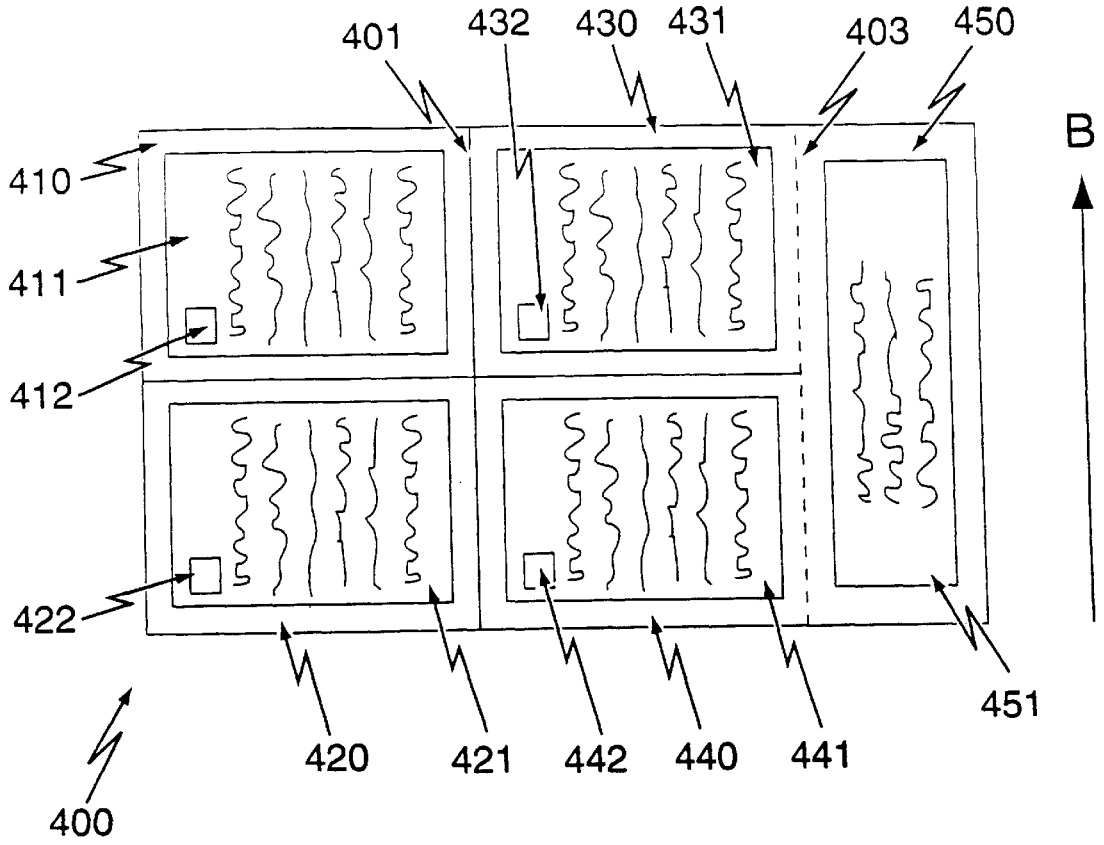
FIG. 4 is the front view of an alternative embodiment of the bill in FIG. 3 having four information panels on a side.

FIG. 4 shows an alternative embodiment of the present invention comprising four information panels. Panels 410, 420, 430, 440, 450 are defined by fold lines 401 and 403, and line 402. Panels 410, 420, 430, 440 comprise information 411, 421, 431, and 441 (e.g., account summary, billing information, advertising, or other information). Information 411, 421, 431, and 441 is oriented in a first direction, B. Optionally, each panel may comprise a creditor or source identifier 412, 422, 432, 442 (e.g., company logo). Panel 450 comprises remittance information 451. Remittance information 451 is oriented in the same first direction, B. The reverse side of bill 400 comprises a similar four information panel and one remittance panel format (not shown). Alternatively, bill 400 comprises a first side with a two-information panel format, as shown in the top of FIG. 1, and a second side with a four information panel format as shown in FIG. 4.

Additional sheets for FIGS. 3 and 4 (not shown) with one, two, four, or more information panels and no remittance panel are inserted as dictated by the amount of information required in the bill.

Embodiments with more panels per side are especially useful where the amount of information from each source (e.g., account summary, advertising, a plurality of creditors, or other sources) occupies a relatively small space on a sheet of paper (e.g., 8 ½" by 11" or A4 paper) because less "white space" is wasted on unused portions of a larger panel. In a four-panel per side format, information from as many as eight sources is segregated and organized on one sheet of paper. Thus, mailing and production costs are significantly reduced, and comprehension and clarity of the information presentation is improved.

The above description is included to illustrate the operation to the preferred embodiments and is not meant to limit the scope of the invention. The scope of the invention is limited only by the following claims. From the above discussion, many variations will be apparent to one skilled in the art that are yet encompassed by the spirit and scope of the invention.

What is claimed is:

1. A bill comprising:

a first sheet having first and second sides, the first side of the first sheet comprising:

at least two portrait oriented information panels having information therein oriented in a horizontal direction, wherein the information panels are connected together by at least one fold line running along a vertical direction; and a single layer landscape oriented remittance panel having remittance information therein oriented in the vertical direction, wherein the remittance panel is connected to one of the information panels by a perforation line running along the vertical direction.

2. The bill of claim 1 wherein at least one of the information panels includes billing information from a creditor.

3. The bill of claim 2 wherein at least two of the information panels includes billing information from at least two creditors, wherein the billing information of each creditor is displayed in separate information panels.

4. The bill of claim 1 wherein at least one of the information panels includes summary information.

5. The bill of claim 1 wherein at least one of the information panels includes advertising information.

6. The bill of claim 1 wherein at least one of the information panels includes source identification.

7. The bill of claim 1 wherein at least two of the information panels includes information in at least two languages, wherein the information in the at least two languages is displayed in separate information panels.

8. The bill of claim 1 wherein the remittance information includes creditor information.

9. The bill of claim 8 wherein the creditor information is encoded in a bar code.

10. The bill of claim 1 wherein the remittance information includes debtor information.

11. The bill of claim 10 wherein the debtor information is encoded in a bar code.

12. The bill of claim 1 having four information panels on the first side of the first sheet.

13. The bill of claim 1 wherein the second side of the first sheet comprises:

at least two portrait oriented information panels having information therein oriented in the horizontal direction and connected together by the at least one fold line; and a single layer landscape oriented remittance panel having remittance information therein oriented in the vertical direction, wherein the remittance panel is connected to one of the information panels of the second side of the first sheet by the perforation line.

14. The bill of claim 1 further comprising a second sheet having first and second sides, the first side of the second sheet comprising:

at least two portrait oriented information panels having information therein oriented in the horizontal direction and connected together by at least one fold line running along the vertical direction.

15. The bill of claim 14, wherein the first and second sheets are folded along a common fold line such that information in the information panels appear in a book-like fashion.

16. The bill of claim 1 wherein the first sheet is 8 ½ inches by 14 inches.

17. The bill of claim 1 wherein the first sheet is the width of standard A4 paper.

18. The bill of claim 1 having four information panels on the first side of the first sheet.

19. A method for generating a bill, the bill having two or more information panels having information therein oriented in a horizontal direction, and a remittance panel having remittance information therein oriented in a vertical direction, the method comprising:

receiving a continuous paper having a plurality of sheets defined therein;

defining at least two portrait oriented information panels having information therein oriented in the horizontal direction on a first sheet of the continuous paper, wherein the information comprises billing information from a creditor, the billing information from the creditor displayed in the information panels;

defining a single layer remittance panel having remittance information, comprising debtor information therein, oriented in the vertical direction on the first sheet of the continuous paper;

printing the bill having at least one information panel having information therein oriented in the horizontal direction, and a remittance panel having remittance information therein oriented in the vertical direction;

perforating the continuous paper at a first end of each remittance panel such that the remittance panel is connected to one of the information panels by a perforation line running along the vertical direction;

cutting the continuous paper at a second end of each remittance panel to form sheets of the bill; and folding the continuous paper such that the information panels are connected together by at least one fold line running along the vertical direction.

20. The method of claim 19 wherein the continuous paper is two sheets wide and the bills are printed side-by-side two at a time.

21. A bill comprising:

a first sheet having first and second sides, the first side of the first sheet comprising:

at least two portrait oriented information panels having information therein oriented in a horizontal direction, wherein the information comprises billing information from a creditor, the billing information from the creditor displayed in the information panels, wherein the information panels are connected together by at least one fold line running along a vertical direction; and a single layer landscape oriented remittance panel having remittance information, comprising debtor information therein, oriented in the vertical direction, wherein the remittance panel is connected to one of the information panels by a perforation line running along the vertical direction.

* * * * *

UNITED STATES PATENT AND TRADEMARK OFFICE

CERTIFICATE OF CORRECTION

PATENT NO. : 5,951,052

DATED : September 14, 1999

INVENTOR(S) : Pamela M. Hansen, Larry N. Rebenack, Phyllis J. Buckman, Carol L. Rohrkemper

It is certified that error appears in the above-identified patent and that said Letters Patent is hereby corrected as shown below:

In the Abstract, line 13: after "generally" delete "tom" and insert --torn--
Column 1, line 10: after "No." delete "2,385,298" and insert --D385,298--
Column 2, line 52: after"by" delete "1141" and insert --11--
Column 3, line 53: after "generally" delete "tom" and insert --torn--

Signed and Sealed this

Twenty-fifth Day of April, 2000

*Attest:*

Q. TODD DICKINSON

*Attesting Officer*

*Director of Patents and Trademarks*